US005527076A

United States Patent [19]

Randels

[11] Patent Number: 5,527,076

[45] Date of Patent: Jun. 18, 1996

[54] BAG HANDLE

[76] Inventor: Robert Randels, 602 W. Franklin St., #3, Baltimore, Md. 21201

[21] Appl. No.: 333,644

[22] Filed: Nov. 3, 1994

[51] Int. Cl.[6] ..... A45C 13/26; B65D 33/06

[52] U.S. Cl. ..... 294/25; 294/171

[58] Field of Search ..... 294/25, 27.1, 31.2, 294/33, 137, 153, 156, 159, 166, 170, 171; 16/110 R, 114 R, 114 B; 383/6, 12, 13, 15, 23, 25, 26, 29; 224/217–219, 222, 251, 267

[56] References Cited

U.S. PATENT DOCUMENTS

| | | | |
|---|---|---|---|
| D. 288,278 | 2/1987 | Bright | 294/33 X |
| 562,027 | 6/1896 | Reaser | 294/25 X |
| 670,023 | 3/1901 | Jump | 294/25 X |
| 1,359,717 | 11/1920 | McCarthy | 294/25 |
| 2,301,842 | 11/1942 | Abdella | 294/25 X |
| 2,556,189 | 6/1951 | Johnson | 294/25 |
| 2,967,071 | 1/1961 | Deschene | 294/31.2 |
| 3,486,684 | 12/1969 | Dills et al. | 294/171 |
| 3,912,140 | 10/1975 | Franges | 294/171 X |
| 4,004,722 | 1/1977 | Olivier | 294/171 |
| 4,590,640 | 5/1986 | Enersen | 294/171 X |
| 4,606,484 | 8/1986 | Winter et al. | 294/25 X |
| 4,846,518 | 7/1989 | Hamel | 294/27.1 X |
| 4,846,519 | 7/1989 | Leonard | 294/171 |
| 4,923,235 | 5/1990 | Stewart | 294/171 X |
| 4,936,619 | 6/1990 | Salazar | 294/171 |
| 5,029,926 | 7/1991 | Dieterich | 294/171 |
| 5,199,758 | 4/1993 | Howell | 294/171 |

*Primary Examiner*—Johnny D. Cherry

[57] ABSTRACT

A bag handle for carrying one or more plastic bags typically used in grocery stores or other handle-bearing objects such as paint cans. The handle has a slotted cylindrical portion which is used to house the bag's handles. The slot is angled allowing a sliding motion to access the holding cylinder easily. The handle is flexible for convenience and comfort and has a support strap which the hand is inserted into to provide enough rigidity to support the bags.

5 Claims, 2 Drawing Sheets

BAG HANDLE

BACKGROUND OF THE INVENTION

"Paper or plastic" is an expression commonly heard by anyone checking out of a grocery store today. However, for years before stores started using plastic bags, the only option available to consumers was to use the brown paper bags, either in single strength or in doubled-up for over-stuffing strength. While these bags were inconvenient as being difficult to lift, transport, store, and fold, they did offer an additional use as a waste receptacle liner. Noticing major difficulty associated with carrying and transporting groceries in these paper bags, the grocery stores began using thin plastic bags with handles and unknowingly gave birth to the expression "paper or plastic". As people began to realize the advantages offered by plastic bags, in that they are easier to carry, easier to store, and are kinder to trees, popularity grew.

Since the plastic bags' handles made them easier to carry, multiple bags can now be transported without using the two arm-four bag technique mastered by anyone shopping in the "paper" era. The ease in carrying multiple bags has not come without sacrifice. The weight associated with carrying many bags creates an uncomfortable pressure on the palm of the hand as the weight of the bags squeezes the hand into a painful concave position.

In an effort to alleviate these problem and additionally provide added comfort, Stewart in U.S. Pat. No. 4,923,235 and Dieterich, Jr. in U.S. Pat. No. 5,029,926 disclose two similar devices for carrying bags. The two devices are rigid, elongated, straight members which contain slots at the ends to hold the bag's handles and are narrow to fit inside the palm of a hand.

Other U.S. Patents in this area include U.S. Pat. No. 4,590,640 issued to Enerson, U.S. Pat. No. 4,936,619 issued to Salazar, and U.S. Pat. No. 5,199,758 issued to Howell. Enerson's handle incorporates a rigid, elongated member evenly slotted on a side to accept the bags' handles and is elongated to fit into the palm of a hand.

Salazar discloses a handle for carrying multiple bags in an elongate tubular member incorporating outwardly diverging panels to facilitate the handle's entrance into the device.

Howell's handle incorporates a tubular member, elongated and having a slot spiraling through its body. Bag handles are inserted by rotating the tube with the handle at the beginning of the slot. The tube is narrow so that the apparatus is easily carried.

However, none of these references show a handle which is both flexible for carrying many bags or other other articles having different sized handles which is also supporting.

SUMMARY OF THE INVENTION

This present invention relates to a bag handle. More particularly, this invention relates to a bag handle that is used for carrying one or more plastic bags commonly used in grocery stores.

The invention has been tested and reduced to practice by the applicant and provides several advantages over the prior art.

The handle is to be fabricated out of flexible material to allow it to be carried with little inconvenience when not in use. Furthermore, the flexible material will add to the comfort of using this device when carrying bags of substantial weight.

Although the handle is designed to be flexible, it will become rigid when in use as it completely wraps around the user's hand. Extending upward from the palm portion of the wrap-around segment is a slotted cylindrical portion also made of a flexible material, designed to accept and contain the handles of one or more plastic bags.

The slotted cylindrical portion of the handle advantageously incorporates an angled slot. This enables and facilitates entrance of the bag handles into the device. The handles are pulled into the wide opening of the angled slot and slid across and out the narrow end where they are then situated within the cylinder. The next bag is then easily slid on top of its predecessor.

However, the slot in the slotted cylinder is narrow enough to retain the bag handle even when pressure is removed and the bag and the handle are free standing.

The slotted cylinder is also flexible and acts as a locking mechanism when pressure is applied to it by a hand. When this happens, by gripping the handle to carry the bags, the slotted cylinder's sides overlap one another closing the cylinder and thereby prevent any accidental release of the bags.

The device may be made as one complete entity or may be a strap that is fastened into a similar entity by a hook and slot or other fastener located on the two ends of the support loop.

It is therefore an object of this invention to provide a comfortable device to aid in carrying multiple plastic grocery bags, paint buckets, pails, and packages wrapped with twine.

It is a further object of this invention to provide an embodiment of the invention that is singular and flat to aid in manufacture.

It is even another object of this invention to provide a means to keep plastic bag handles together when not being carried so that the bag will remain closed.

BRIEF DESCRIPTION OF THE DRAWINGS

The above and other objects, features, and advantages of the invention will become more readily apparent from the following with reference to the accompanying drawings in which.

DETAILED DESCRIPTION OF THE DRAWINGS

Figure 1:
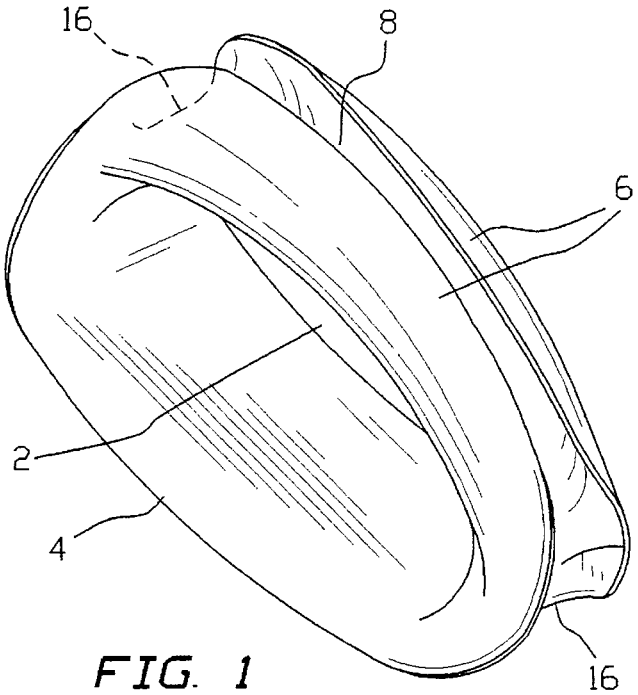
FIG. 1 is an isometric view of the device depicting the oblong opening in which the user's hand is inserted.

FIG. 1 illustrates the connection between the oblong hand opening 2 and the slotted cylinder 8. The oblong opening 2 is shaped to receive a human hand when the palm and fingers are grasping the slotted cylinder 8. The lower support strap 4 of the hand opening 2 wraps around the back of the inserted hand and is crucial to supporting the entire device.

Since this invention is made of a flexible material so that it is comfortable to use, it will need the rigidity offered by the support strap 4 to effectively carry the plastic bags. When a hand is inserted into the device, the lower strap 4 experiences tensile forces due to the stretching of the oblong hand opening 2 as it is slightly smaller than periphery surface of a typical hand. This tension will cause the flexible material of the device to become rigid enough to support the bag handles as well as prevent the device from sliding into a different position on the hand.

Figure 2:
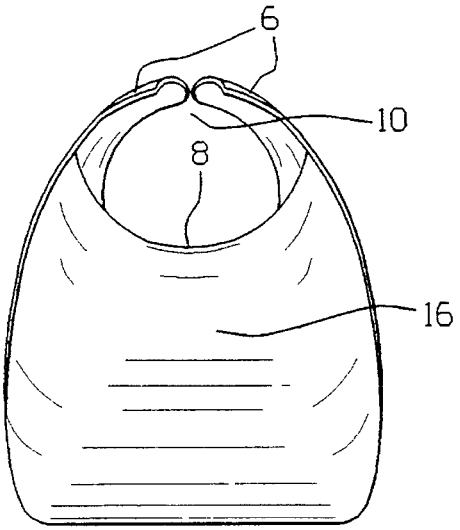
FIG. 2 is a front elevation of the device depicting the slotted cylindrical cavity which is to hold the bag handles.

A frontal view of the slotted cylinder 8 is illustrated in FIG. 2. Both ends of the slotted cylinder 8, at the portions directly opposite the slot 10, extend convexly downward at 16 and connect to each other, creating the lower support strap 4. The slotted cylinder 8 and the convex extensions 16, in creating the lower support strap 4, also create the oblong hand opening.

The open slot 10 is the entrance into the cylindrical holding chamber 8 for the bag handles. While the lower support strap 4 creates enough rigidity to support the bags, the cylinder 8 is still capable of a small amount of flexibility when a sufficient force is applied by the hand. This flexibility will provide a means of locking the bags within the device. Once the bag handles are placed into the cylinder 8 and the cylinder sides 6 are squeezed, the sides 6 will overlap eliminating the slot 10 until the cylinder 8 is released. When released, the bag handles can be removed as the resilient material will cause the slot 10 to reform. In addition, the narrow end 12 of the slot 10 will prohibit the bag's handles from coming out of the device when they are set down. This feature of the device helps to keep the bag closed when not being carried.

Figure 3:
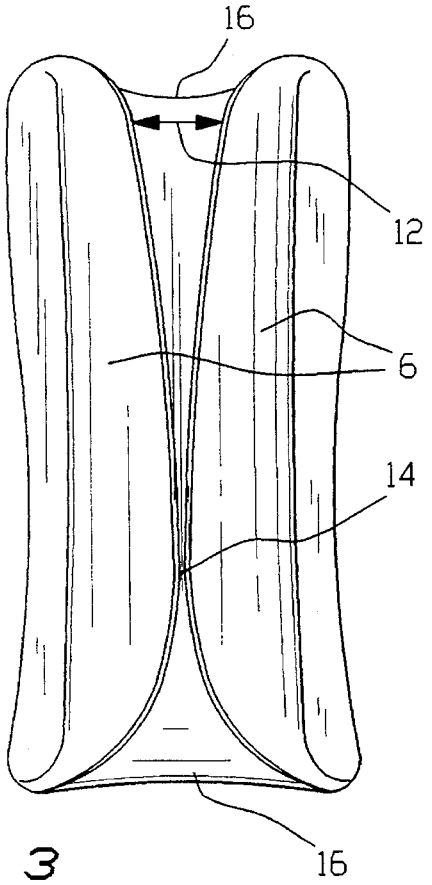
FIG. 3 is a top view of the device depicting the angled edges of the slotted cylindrical cavity.

The slot 10 of the cylinder 8 is illustrated in the top view of the device in FIG. 3. The cylinder walls 6 intentionally do not create a slot 10 with parallel edges. The angled edges allow for the user of the device to easily insert and remove the bag handles from the holding cylinder 8.

While the device is on the hand, a bag's handles are placed at the entrance 14 to the cylinder 8. The entrance 14 is the end of the cylinder whose slot's angled edges are farthest apart 14. The handles are then slid across the cylinder 8 until they pass through the narrowest section 12 of the slot 10 in which case they are inside the cylinder and ready to be carried. If multiple bags are being carried, this process is repeated for each additional bag to be carried.

To remove a bag from the holding cylinder 8 the process is again repeated except the handles sliding across the device are ones which are already inside the cylinder 8. Therefore, upon execution of the process, the handles will be free.

Figure 4:
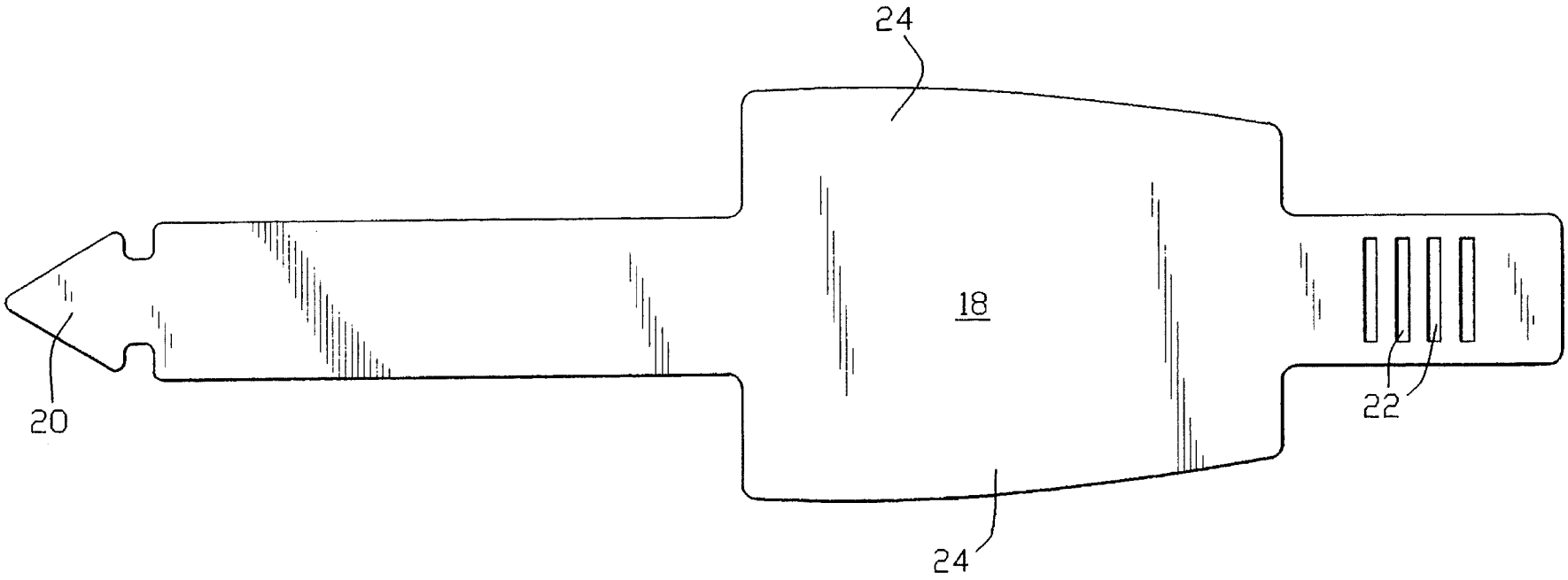
FIG. 4 is a top view of the device in its alternative embodiment showing the hook and slot fastener in a layout for efficient manufacturing.

FIG. 4 shows an alternative embodiment of the invention. In this embodiment, the handles will be constructed out of a flexible, flat sheet of material 18. To form the device from the flat pattern, the user will connect one end 20 of the support strap with the other end 22. The two ends will then be locked into place by a hook 20 and slot 22 fastener and will be adjustable due to differing slot distances 22. Two wide portions 24 will create the slotted cylinder when locked onto the hand and gripped. This embodiment will effectuate efficiency in manufacturing and storage.

Both of these embodiments can and are intended to be fabricated out of recycled material. The hook and slot embodiment can additionally be fabricated out of inexpensive material and therefore be disposable.

The preceding description represents this invention in its preferred embodiment. It is understood that this invention could be used for one or more pails, buckets, wire bails, paint containers, packages bound with twine and other items besides plastic grocery bags without deviating from the scope of the claims of this invention.

What is claimed is:

1. A handle comprising:

a substantially cylindrical slotted member; and a support strap, wherein said substantially cylindrical slotted member and said support strap are practically equal in length, and are seamlessly merged into a continuous oblong hand opening formed integrally therefrom; and upon insertion of a hand into said oblong hand opening, said substantially cylindrical slotted member will reside within the palm of said inserted hand, with its slot facing outwards, away from said palm, while said support strap will reside on the back portion of said inserted hand.

2. A handle as recited in claim 1, wherein said slot of said substantially cylindrical slotted member has an entrance end and an exit end, wherein said entrance end is wider in respect to said exit end creating an angle in said slot.

3. A handle as recited in claim 2, wherein said exit end is substantially closed prohibiting articles that have been slid through said entrance end and said exit end from coming out of said substantially cylindrical slotted member without adding a force from a user.

4. A handle as recited in claim 3, wherein said substantially cylindrical slotted member is resiliently flexible, such that upon closing said inserted hand thereon, said entrance end and said exit end will temporarily close by overlapping of the edges of said slot, and reopen only upon reopening of said inserted hand.

5. A handle as recited in claim 4, wherein said oblong hand opening is not permanently continuous, such that it can be separated and reconnected along said support strap by any fastening means operable by hand manipulation.

* * * * *